US005354002A

United States Patent [19]

Folsberg

[11] Patent Number: 5,354,002

[45] Date of Patent: Oct. 11, 1994

[54] DOUBLE SEPARATOR FOR SORTING PARTICULATE MATERIAL

[75] Inventor: Jan Folsberg, Valby, Denmark

[73] Assignee: F. L. Smidth & Co. A/S, Denmark

[21] Appl. No.: 50,379

[22] PCT Filed: Nov. 13, 1991

[86] PCT No.: PCT/DK91/00340

§ 371 Date: May 14, 1993

§ 102(e) Date: May 14, 1993

[87] PCT Pub. No.: WO92/09376

PCT Pub. Date: Jun. 11, 1992

[51] Int. Cl.[5] ..... B07B 7/083; B02C 23/08

[52] U.S. Cl. ..... 241/79.1; 241/152.2; 209/139.2

[58] Field of Search ..... 241/79.1, 152.2; 209/139.2, 144, 148

[56] References Cited

U.S. PATENT DOCUMENTS

| | | | |
|---|---|---|---|
| 1,746,686 | 2/1930 | Sturtevant | 209/139.2 |
| 4,689,140 | 8/1987 | Folsberg | 209/139.2 |
| 4,869,786 | 9/1989 | Hanke | 209/139.2 |
| 5,005,770 | 4/1991 | Suessegger | 241/19 |
| 5,024,754 | 6/1991 | Patzelt et al. | 209/135 |

FOREIGN PATENT DOCUMENTS

| | | |
|---|---|---|
| 220069 | 4/1958 | Australia . |
| 23320 | 2/1981 | European Pat. Off. . |
| 210729 | 2/1987 | European Pat. Off. . |
| 1913946 | 12/1970 | Fed. Rep. of Germany . |

OTHER PUBLICATIONS

1985 Cement-Data-Book, 3d Edition, by Walter H. Duda, pp. 262–263, 272–288.

Dialog Database English Language Abstract relating to DE 1913946 (Dec. 23, 1970).

*Primary Examiner*—Timothy V. Eley
*Assistant Examiner*—John M. Husar
*Attorney, Agent, or Firm*—Brumbaugh, Graves, Donohue & Raymond

[57] ABSTRACT

A double separator for sorting particulate material, e.g. raw materials of cement or cement clinker comminuted in a roller press, and in which the material charge is suspended in a conveying gas, and consisting of a coarse separator (2), on top of which a fine separator (1) is mounted directly. The coarse separator (2) has a material inlet duct (15), a centrifugal pulverizer or rotor with arms (16) forming a disagglomerator, a gas inlet duct (18) and a material outlet duct (21) for a separated coarse fraction. The fine separator (1) has a material gas inlet duct (9), an additional material inlet duct (11), an outlet duct (3) for a fine fraction in suspension and an outlet duct (10) for a separated coarser fraction.

8 Claims, 2 Drawing Sheets

DOUBLE SEPARATOR FOR SORTING PARTICULATE MATERIAL

BACKGROUND OF THE INVENTION

The present invention relates to a separator for sorting particulate material into coarse and fine fractions, e.g. raw materials of cement or cement clinker or similar mineral raw materials which have been ground under high pressure in a roller press, resulting in that the ground material contains agglomerates which have to be desagglomerated before the material can be further treated.

Separators for sorting out a fine fraction from a coarse fraction of ground, particulate material are disclosed e.g. in the form of air separators in i.a. AU patent No. 220,069, DE patent No. 1,913,946, EP patent specification No. 0,023,320 and EP patent specification No. 0,210,729 and in Duda: Cement Data Book 1, chapter 15 (3rd edition, Bauverlag GmbH, Wiesbaden and Berlin, 1985). When using such air separators in their present form of single separators in connection with roller presses, the material charge has usually been subjected to a separate desagglomeration process, e.g. in a hammer mill, prior to the separation process in order to disintegrate the agglomerates, which entails an increase in the number of individual machines in the grinding plant and wear and tear of the hammer mill. The inevitable dust formation in the hammer mill causes dust-laden material to be conveyed to the separator.

As a continuously increasing part of the grinding tends to take place in the roller press this furthermore results in that the separator has to treat a continuously increasing amount of material due to an increase in the closed-circuit rate. As a result the material concurrently becomes coarser which again results in increased wear and tear and an even higher power consumption in the separator.

When subsequently using a tube mill in such prior art single separator plants to comminute the separated roller-pressed material charge into fine particles, the material supplied to the tube mill has up to now either been characterized in containing large single particles, which require large grinding bodies in the tube mill, or the tube mill has been fed with semi-ground material of a relatively high fineness, resulting in the dry material tending to clog in the tube mill.

Further, from EP-A2-0250747 a double separator of the air separator type is known for sorting particulate material suspended in a conveying gas, where the double separator comprising an upper coarse separator coupled in series with and directly connected to a lower fine separator. Both the upper and lower separators are provided with rotors rotating about vertical shafts, each rotor having adjustable louvre blades. The upper, coarse separator being a horizontal, centrifugal impact pulveriser having arms for disagglomerating coarse material containing agglomerates From a crushing device, such as a roller mill, the material load of which is charged to the separator through an inlet duct mounted in the upper part of the coarse separator; space is provided between the arms of the impact pulverizer allowing the separated parts of the coarse fraction suspended in the conveying gas to be passed through the separator housing into the lower separator For Further treatment in same.

Compared to the previously mentioned single separator plants, the double separator according to EP-A2-0250747 only differs from these in having the external disagglomerator, such as a separate hammer mill, replaced by the upper coarse separator functioning as a built-in desaggtomerator, for which reason the use of this double separator in principle entails the same disadvantages as described in connection with the single separator plants.

It is therefore the object of the present invention to provide a separator which can be used together with a roller press and optionally together with a tube mill and in which the above mentioned drawbacks are avoided.

SUMMARY OF THE INVENTION

The object of the present invention is obtained by means of a separator of the air separator type for sorting particulate material suspended in a conveying gas, the double separator comprising two separators coupled in series. Each separator is provided with rotors, rotatable about vertical shafts and having adjustable louvre blades wherein at least one of the separators comprises a horizontal centrifugal impact pulverizer functioning as a disagglomerator of coarse material containing agglomerates supplied from a crushing unit. The double separator further comprises a housing having a plurality of inlet ducts for receiving supplied material, a plurality of outlet ducts for separating out coarse fractions of material, an upper end outlet duct disposed at the upper end of the housing for separating out the separated fine fraction of material, and a tangential inlet disposed at the lower circumference of the housing for supplying a conveying gas. The two separators of the double separator comprises a lower coarse separator (2) and an upper fine separator (1), the lower part (9) of the upper separator being directly connected to the upper part (10) of the lower separator, the lower coarse separator (2) is provided with an inlet duct (15) for supplying the material load of coarse material from a roller press into the coarse separator. The horizontal centrifugal impact pulverizer is disposed within the lower coarse separator (2) and comprises arms (16) and spaces provided between the arms of the impact pulverizer of the lower coarse separator functioning as a disagglomerator, the spaces allowing the separated fine parts of the coarse fraction of material suspended in the conveying gas to be conveyed upwards through double separator housing parts (14, 13 and 9) into the upper fine separator (1) for further treatment in the fine separator. The outlet duct (21) of the coarse separator (2) for sorting the separated coarse fraction of material is connected to the roller press.

The surprising new aspect of the present invention is thus the placing the coarse separator under the fine separator thereby obtaining a cleaner fine fraction of the treated product and the possibility of producing an intermediate fine fraction (for the tube mill) and of receiving an intermediate fine fraction without the necessity of passing it through the coarse separator stage.

Such a separator allows for an increase in the feed load from the roller press to the coarse separator higher than that for presently known separator types and for obtaining a relatively high separation degree (low "cut size") with the coarse separator, which relieves the fine separator so %hat a low specific separator effect for the separator as a whole is obtained.

The coarse fraction of the coarse material which is separated in the coarse separator is returned to the roller press, thereby increasing the possibilities of utilizing said press more efficiently while the coarse fraction of the fine material being separated in the fine separator is fed to the tube mill being a closed-circuit mill of the single-chamber type using small grinding bodies, thereby resulting in an improved tube mill efficiency due to the fact that neither great single particles nor ultra fine material, but merely a medium fraction of material is supplied to the tube mill.

BRIEF DESCRIPTION OF THE DRAWINGS

The invention will now be explained in further detail in the form of an example and with reference to the drawing in which.

DESCRIPTION OF THE PREFERRED EMBODIMENT

Figure 1:
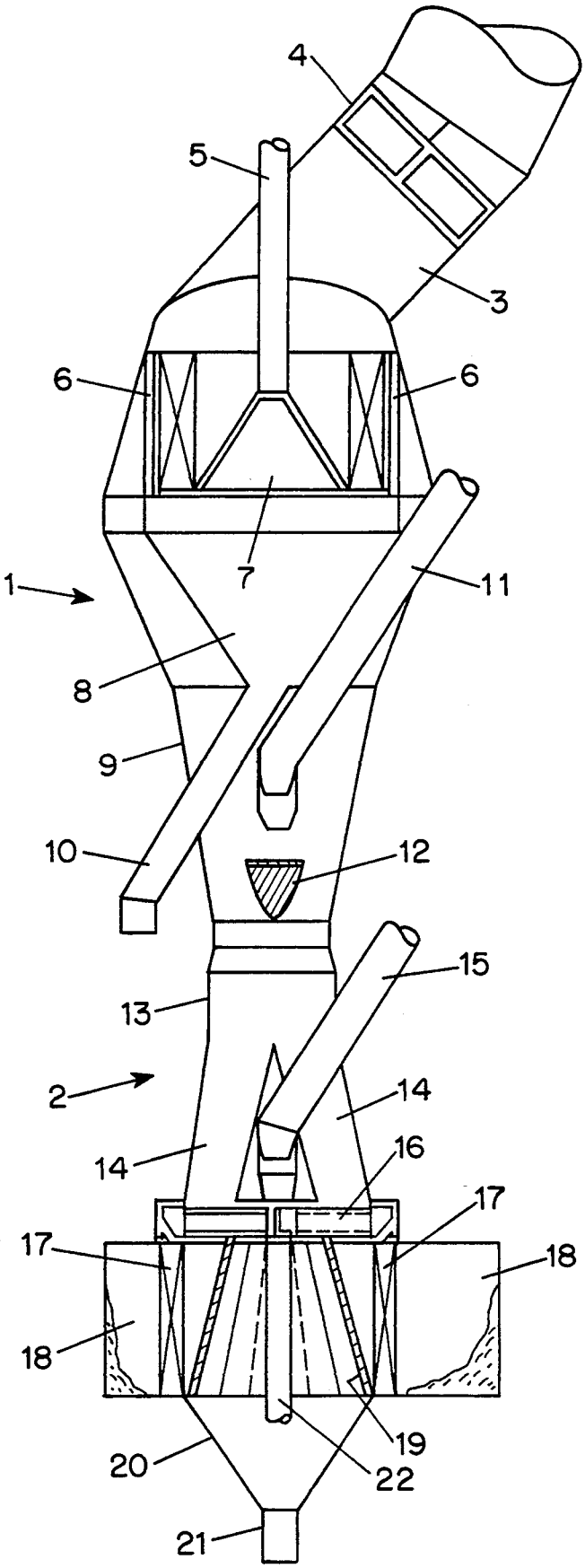
FIG. 1 shows a vertical section through a double separator according to the invention and FIG. 2 shows more detailed a part of the lowermost separator.

The double separator consists of a coarse separator 2, on top of which a fine separator 1 is mounted, the circumference of the top of the housing 13 of the separator 2 corresponding to the circumference of the bottom of the housing 9 of the separator 1 so that a suspension of material-gas is allowed to pass directly from the separator 2 into the separator 1. A suspension outlet duct 3 in which inside fittings 4 may be inserted to reduce the pressure loss is provided at the top of said separator 1. A vertical driving shaft 5 connected to driving means (not shown) causes the rotor 7 of the separator 1 to rotate. Outside the rotor 7 and along the circumference of said rotor the separator 1 is provided with louvre blades 6 which are adjustable so that the position of the louvre blades, the velocity of the rotor and the amount of supplied air can be adjusted to the desired degree of separation of material from the gas stream. Apart from the amount of material supplied to the separator 1 via the conveying gas from the separator 2, the separator 1 may be charged with material via the inlet duct 11 which is connected to a tube mill (not shown), to which mill the separator 1 is in closed circuit. Sorted coarse material which is separated from the suspension after treatment of the suspension in the separator 1 is directed to the tube mill via the hopper 8 and the outlet duct 10, or optionally to the roller press for renewed comminution.

The separator 2 has an inlet duct 15 which is connected to a roller press (not shown) in which the material charge is comminuted under high pressure so as to form i.a. agglomerates. The treated material is fed directly from the roller press into the rotor of the separator 2 via the inlet duct 15. Said rotor is a horizontal, centrifugal impact pulverizer which throws the agglomerate-containing material towards the stationary vertical rotor wall 16' by means of rotating arms 16 (vide FIG. 2), thereby causing at least the material agglomerates to be crushed by impact against the wall 16'. After the impact against the wall 16' the treated material falls downwards outside the rotor, which apart from the impact pulverizer or desagglomerator also consists of the drive shaft 22. Moreover the rotor may have an outwardly extending cone 19. The coarse material separator may furthermore be provided with one or more sets of adjustable louvre blades 17. During the passage of the material down between the rotor and the louvre blades the finer part of the fraction is caught by the conveying gas which is fed to the coarse separator 2 via the tangential inlet 18 and conveyed together with the gas up through the spaces between the arms 16 of desagglomerator and further through the housing parts 14 and 13 up into the fine separator 1 via a dispersing part 12, whereas the coarse part of the fraction from the coarse separator 2 is conveyed into the outlet duct 21 via the hopper 20 and from the outlet duct back to the roller press for renewed comminution.

Figure 2:
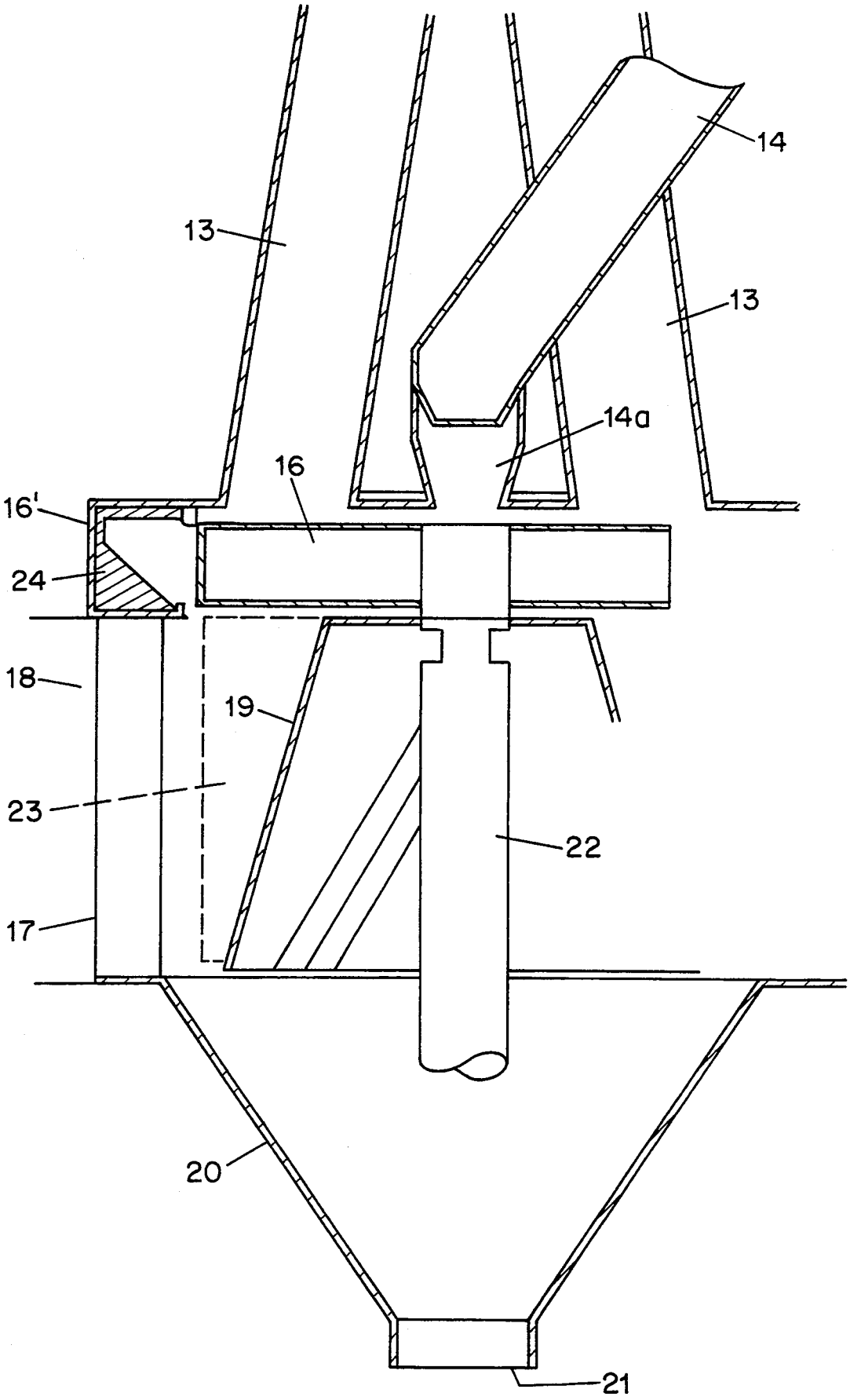

The desagglomerator rotor may be a centrifugal pulverizer of a known type and in which pulverization may also be effected by impact of discharged material against an impact cushion 24 formed by a material charge deposited on the inside of the rotor wall 16' (vide FIG. 2).

In a particular embodiment of the invention the cone 19 in the coarse separator 2 has a plurality of vanes 23 to increase the separation effect. Correspondingly the desagglomerator rotor in the spaces between the arms 16 may have vanes (not shown) to increase the separation effect.

The degree of separation ("cut size") in the coarse separator is adjusted in the manner similar to the one indicated above for the fine separator by regulating the amount of supplied air and gas and by adjusting the louvre blades and the rotor velocity. Additionally regulation may further be effected through the plurality of vanes on the cone 19 and between the rotor arms 16.

I claim:

1. A double separator of the air separator type for sorting particulate material suspended in a conveying gas, the double separator comprising two separators coupled in series wherein each separator is provided with rotors, rotatable about vertical shafts and having adjustable louvre blades, and wherein at least one of the separators comprises a horizontal centrifugal impact pulverizer functioning as a disagglomerator of coarse material containing agglomerates supplied from a crushing unit, the double separator further comprising a housing having a plurality of inlet ducts for receiving supplied material, a plurality of outlet ducts for separating out coarse fractions of material, an upper end outlet duct disposed at the upper end of the housing for separating out the separated fine fraction of material, and a tangential inlet disposed at the lower circumference of the housing for supplying a conveying gas, characterized in that the two separators of the double separator comprises a lower coarse separator (2) and an upper fine separator (1), the lower part (9) of the upper separator being directly connected to the upper part (13) of the lower separator, the lower coarse separator (2) is provided with an inlet duct (15) for supplying the material load of coarse material from a roller press into the coarse separator, the horizontal centrifugal impact pulverizer is disposed within the lower coarse separator (2) and comprises arms (16) and spaces provided between the arms of the impact pulverizer of the lower coarse separator functioning as a disagglomerator, the spaces allowing the separated fine parts of the coarse fraction of material suspended in the conveying gas to be conveyed upwards through double separator housing parts (14, 13 and 9) into the upper fine separator (1) for further treatment in the fine separator and the outlet duct (21) of the coarse separator (2) for sorting the separated coarse fraction of material is connected to the roller press.

2. A double separator according to claim 1, characterized in that the cone (19) under the rotor of the coarse separator (2) is mounted on a rotor shaft (22) and that it rotates together with the shaft.

3. A double separator according to claim 2, characterized in that the spaces between the arms (16) of the rotor of the coarse separator are provided with vanes to increase the separation effect.

4. A double separator according to claim 1 or 3, characterized in that the cone (19) under the rotor of the coarse separator (2) is provided with a plurality of vanes (23) to increase the separation effect.

5. A double separator according to claim 4, characterized in that the spaces between the arms (16) of the rotor of the coarse separator are provided with vanes to increase the separation effect.

6. A double separator according to claim 1, characterized in that the spaces between the arms (16) of the rotor of the coarse separator are provided with vanes to increase the separation effect.

7. A double separator according to claim 1, characterized in that an inlet duct (11) provided in the fine separator (1) for receiving supplied material is connected to a tube mill which is in closed circuit with the double separator and that an outlet duct (10), provided in the fine separator (1) for separating out the coarse part of the fine fraction of the material separated in the fine separator, is connected to the tube mill.

8. A double separator according to claim 1, characterized in that an inlet duct (11) provided in the fine separator (1) for receiving supplied material is connected to a tube mill which is in closed circuit with the double separator and that an outlet duct (10), provided in the fine separator (1) for separating out the coarse part of the fine fraction of the material separated in the fine separator, is connected to the roller press.

* * * * *

UNITED STATES PATENT AND TRADEMARK OFFICE

CERTIFICATE OF CORRECTION

PATENT NO. : 5,354,002

DATED : October 11, 1994

INVENTOR(S) : J. Folsberg

It is certified that error appears in the above-indentified patent and that said Letters Patent is hereby corrected as shown below:

Title page, Item 86, 2nd and 3rd lines, "May 14" should read --May 12--;

Title page, Item 30, Foreign Application Priority Data --Danish patent application Serial No. 2804/90 filed November 26, 1990—.

Col. 5, line 13, "claim 1 or 3" should read --claim 1 or 2--.

Signed and Sealed this

Sixth Day of June, 1995

*Attest:*

*Attesting Officer*

BRUCE LEHMAN

*Commissioner of Patents and Trademarks*